United States Patent [19]

Elsbett et al.

[11] Patent Number: 4,825,830

[45] Date of Patent: May 2, 1989

[54] PUMP SYSTEM FOR INJECTION OF FUEL INTO THE COMBUSTION CHAMBERS OF INTERNAL COMBUSTION ENGINES

[76] Inventors: Ludwig Elsbett; Günter Elsbett; Klaus Elsbett, all of Industriestrasse 14-16, D-8543 Hilpoltstein, Fed. Rep. of Germany

[21] Appl. No.: 78,596

[22] Filed: Jul. 28, 1987

[30] Foreign Application Priority Data

Jul. 30, 1986 [DE] Fed. Rep. of Germany ..... 3625716

[51] Int. Cl.[4] ..... F02M 39/00

[52] U.S. Cl. ..... 123/300; 123/495; 123/575

[58] Field of Search ..... 123/575, 299, 300, 495, 123/446, 447; 239/88-95

[56] References Cited

U.S. PATENT DOCUMENTS

| | | | |
|---|---|---|---|
| 4,224,903 | 9/1980 | Mowbray | 123/300 |
| 4,481,921 | 11/1984 | Tsukahara | 123/300 |
| 4,520,724 | 6/1985 | Sitter | 123/575 |
| 4,612,905 | 9/1986 | Dietrich | 123/575 |
| 4,693,227 | 9/1987 | Satou | 123/300 |
| 4,699,103 | 10/1987 | Tsukahara | 123/498 |

FOREIGN PATENT DOCUMENTS

| | | | |
|---|---|---|---|
| 969853 | 7/1958 | Fed. Rep. of Germany | 123/300 |

*Primary Examiner*—Carl Stuart Miller
*Attorney, Agent, or Firm*—Peter K. Kontler

[57] ABSTRACT

A pump system for injection of fuel into the combustion chamber of a diesel engine has a main pump element which has a plunger for delivery of primary fuel from a first inlet into the chamber at the outlet end of an injection nozzle by way of a conduit including a pipe and a bore in the nozzle. The conduit can further receive one or more additional fuels from one or more additional pump elements which admit additional fuel or fuels at a pressure above the pressure in the conduit during intervals between deliveries of primary fuel but below the pressure which is required to open the nozzle for expulsion of fuel into the combustion chamber. One of the fuels can consist of or can contain a vegetable oil. The main pump element advances the additional fuel stepwise toward the outlet opening of the nozzle.

20 Claims, 1 Drawing Sheet

PUMP SYSTEM FOR INJECTION OF FUEL INTO THE COMBUSTION CHAMBERS OF INTERNAL COMBUSTION ENGINES

BACKGROUND OF THE INVENTION

The invention relates to pump systems in general, and more particularly to improvements in pump systems which can be used to inject fuel into the combustion chambers of internal combustion engines, such as diesel engines.

The pump system which is used to inject fuel into the combustion chamber of an internal combustion engine, such as a spontaneous-combustion engine, normally comprises a pump element which forces fuel to flow from a source into an injector nozzle by way of a delivery or relief valve which is connected with the holder of the nozzle by a high-pressure conduit.

It was already proposed to provide the pump system which serves to supply fuel to the combustion chamber or chambers of an engine with means for admitting several different fuels, either simultaneously or in a selected sequence. Prior proposals include mixing two or more different fuels, admission of fuels to promote ignition and combustion, admission of different fuels during different stages of operation of the engine, and utilization of a first fuel while the engine is hot in order to prepare for injection of a different second fuel whose viscosity, combustibility and/or other characteristics are less satisfactory than those of the first fuel.

In accordance with a presently known proposal, the engine is provided with several injection nozzles for each combustion chamber and each of several nozzles can receive a particular type of fuel. Reference may be had to German Offenlegungsschrift No. 32 21 374. A drawback of such proposal is that additional nozzles contribute to the bulk of the engine and to complexity of the pump system.

German Offenlegungsschrift No. 30 12 418 proposes to provide the nozzle with several inlets each of which extends to the tip of the nozzle to supply a particular type of fuel. The proposal is not entirely satisfactory because it renders it necessary to greatly enlarge the dimensions of the nozzle so that the nozzle can provide separate paths for the flow of different fuels to the outlet opening.

In accordance with a further proposal which is described in German Offenlegungsschrift No. 29 22 682, several types of fuel are supplied through bores in the pin or pintle of the injection nozzle. This proposal has failed to gain acceptance because the dimensions of the pintle [and hence of the entire injection nozzle) must be unduly increased in order to provide sufficiently large paths for the flow of several fuels while at the same time ensuring that the pintle will stand the pressures which develop in the injector nozzle.

All of the above discussed proposals involve the utilization of additional nozzles or substantial modifications of existing nozzles. Further proposals include the provision of plenum chambers in a manner as described in German Offenlegungsschrift No. 29 24 128, storage chambers with valves as described in German Pat. No. 568,366, and even the provision of additional delivery or pressure relief valves as disclosed in German Offenlegungsschrift No. 31 17 796. German Pat. No. 29 32 325 proposes to mix several fuels in the main pump element and to convey the resulting mixture to the injector nozzle.

OBJECTS AND SUMMARY OF THE INVENTION

An object of the invention is to provide a pump system for injection of fuel into the combustion chamber or chambers of an internal combustion engine which is simpler and less expensive than but is at least as versatile as conventional pump systems.

Another object of the invention is to provide a pump system which requires a single main pump element and a single delivery valve as well as a single injector nozzle whose design need not appreciably deviate from the design of heretofore known nozzles.

A further object of the invention is to provide a novel and improved method of injecting several types of fuel into the combustion chamber or chambers of an internal combustion engine.

An additional object of the invention is to provide an internal combustion engine, for example, a spontaneous-combustion engine, which embodies the above outlined pump system.

The invention is embodied in a pump system for injection of fuel into the combustion chamber of an engine, such as a diesel engine. The pump system comprises a main or primary pump element having a first inlet for admission of a first or primary fuel and an outlet for fuel which is admitted by way of the first inlet. The main pump element is arranged to perform strokes for advancement of fuel from the inlet to the outlet, and the pump system further comprises a delivery or relief valve which is connected with the outlet of the main pump element and has a first chamber for fuel which is conveyed by the main pump element, an injector nozzle having a second chamber with an outlet opening for fuel which is to be injected into the combustion chamber, conduit means (such as a pipe or hose and one or more bores in the nozzle) connecting the first and second chambers, and at least one additional inlet for admission of additional or secondary fuel into the conduit means. Thus, the pump system need not be provided with discrete conduit means for the flow of additional fuel from the additional inlet or inlets to the second chamber.

The delivery valve has means (such as a reciprocable valving element and a spring which biases the valving element against a seat at the outlet of the main pump element) for intermittently relieving pressue in the conduit means, and such pump system further comprises an additional or auxiliary pump element which is operative to supply into the conduit means additional fuel by way of the additional inlet while the pressure in the conduit means is relieved by the delivery valve, and check valve means operating between the additional inlet and the conduit means to prevent the flow of fuel from the conduit means into the additional inlet. The additional or auxiliary pump element can be a manually operable element, or it can constitute a power driven pump element. The auxiliary pump element can include means (such as a plunger) for injecting additional fuel by way of the additional inlet at a pressure exceeding the pressure in the conduit means when the pressure in the conduit means is relieved by the delivery valve but being less than the predetermined pressure at which the customary pin or pintle of the nozzle permits expulsion of fuel from the second chamber (such predetermined pressure is generated by the main pump element). The quantities of fuel which the additional or auxiliary pump element can admit into the path for the flow of fuel to the second chamber can depend on the capacity of the conduit means, and the pressure of such fuel is or can be a function of the dimensions of the delivery valve, of the elasticity of fuel in the conduit means and of the pressure of additional fuel which is admitted by the additional pump element.

The main pump element can include a plunger or other suitable means for admitting into the first chamber first predetermined quantities of primary fuel per stroke, and the additional or auxiliary pump element can include means for admitting second predetermined quantities of (additional or secondary) fuel per stroke such that the second quantities do not exceed the first quantities.

The additional inlet or inlets can be provided in the holder of the nozzle. The aforementioned reciprocable pintle is biased by a spring which tends to prevent escape of fuel from the second chamber, and the nozzle has a compartment for the spring and can define a path for circulation of fuel within the nozzle by way of the spring compartment. Such nozzle can be devoid of a lead-off connection to the spring compartment, and the additional inlet then communicates or can communicate with the spring compartment. The nozzle can include a first portion which includes the aforementioned holder and a fluid-discharging second portion which defines the second chamber. The additional inlet or inlets are preferably provided in the first portion of the nozzle. The means for regulating the bias of the spring for the pintle can include a washer-like member in the spring compartment.

The conduit means can communicate with the spring compartment in the nozzle, and such compartment can further communicate with the additional inlet so that the additional inlet communicates with the conduit means by way of the spring compartment. This can obviate the need for a leak-off connection to the spring compartment. A check valve can be provided in the nozzle to prevent flow of fuel from the spring compartment into the additional inlet.

The additional or auxiliary pump element can be designed to admit into the conduit means batches of fuel so that the batches are advanced by way of the conduit means and to the outlet opening of the second chamber in stepwise fashion as a function of the capacity of the conduit means and the frequency of strokes which are performed by the main pump element.

The novel features which are considered as characteristic of the invention are set forth in particular in the appended claims. The improved pump system itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
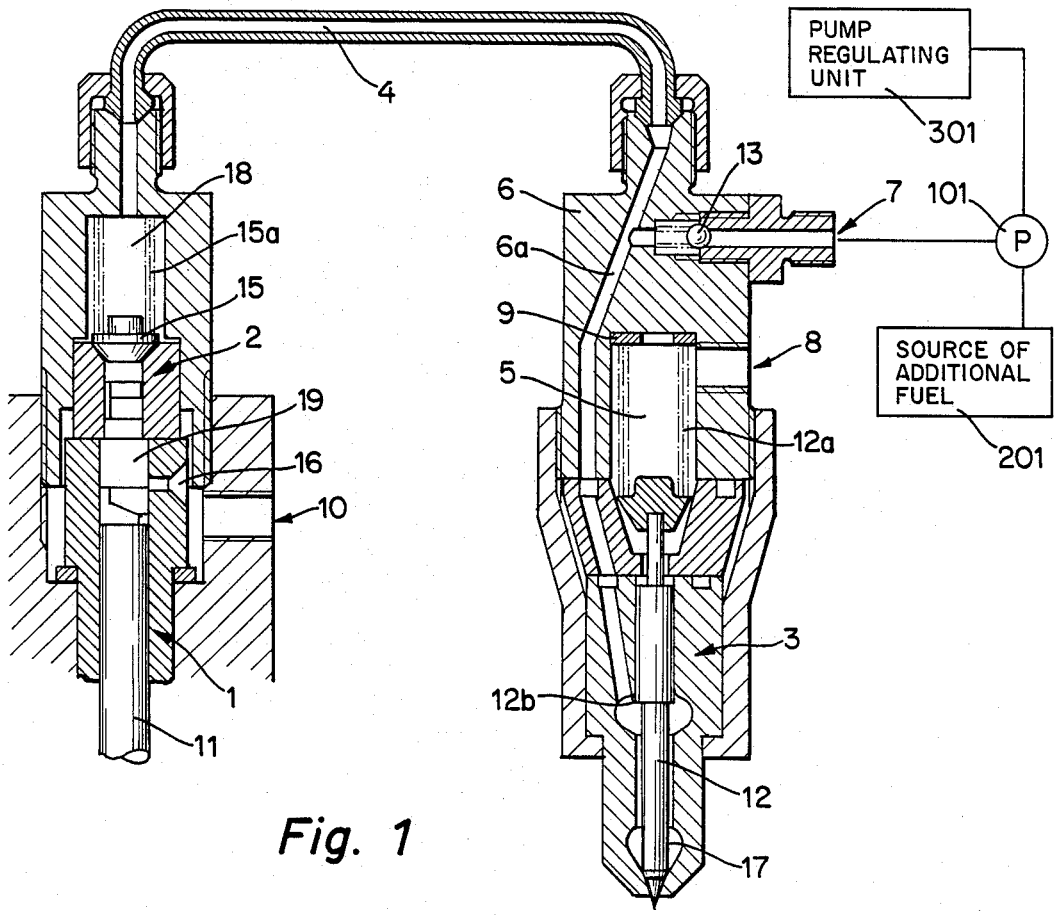
FIG. 1 is a sectional view of a pump system which embodies one form of the invention and wherein the nozzle is provided with a single additional inlet for admission of a second fuel.

Referring first to FIG. 1, there is shown a pump system which can inject fuel into the combustion chamber of an internal combustion engine, for example, into a combustion chamber provided in the top end face of a composite piston of the type disclosed in commonly owned U.S. Pat. No. 4,593,660 granted June 10, 1986 to Ludwig and Gunter Elsbett for "Piston drive for use in diesel engines and the like". The pump system comprises a main pump element 1, a delivery valve 2, an injector nozzle 3 and a conduit 4, **6*a* which connects the valve 2 with a chamber 17 of the nozzle 3. The illustrated conduit includes a pipe or hose 4 and a bore 6*a* in the nozzle 3. The main pump element 1 comprises a reciprocable plunger 11 and has a fuel inlet 10 for admission of fuel from a conventional source, not shown. The inlet 10 admits fuel into an inlet port 16 until the upper edge face of the plunger 11 advances above the level of the port 16 (as seen in FIG. 1) to thereby interrupt communication between the port 16 and an outlet 19 of the main pump element 1. As the plunger 11 continues to rise, it compresses the fuel in the outlet 19 to lift a valving element 15 of the delivery valve 2 against the opposition of a valve spring 15*a* in a spring compartment or chamber 18 which communicates with the pipe 4. Such fuel flows along the path which is defined by the pipe 4 and through the holder 6 of the nozzle 3 into the chamber 17 at the nozzle bottom. The outlet opening in the nozzle bottom is normally sealed by the tip of a pintle or pin 12 which is a component part of the nozzle 3 and can be lifted in the holder 6 against the opposition of a spring 12*a* in a spring compartment 5. The nozzle 3 discharges a spray or jet of fuel until a control edge on the plunger 11 of the main pump element 1 establishes communication between the outlet 19 and the inlet port 16**.

In accordance with a feature of the invention, the pump system of FIG. 1 further comprises a second or additional inlet 7 for additional or secondary fuel which may but need not be the same as the primary fuel which is admitted by way of the inlet 10 of the main pump element 1. The arrangement is such that an additional or auxiliary pump element 101 admits fuel via inlet 7 while the pressure of fuel in the path which is defined in part by the holder 6 of the nozzle 3 is relatively low, i.e., while the pressure between the chambers 17 and 18 is less than the pressure of fuel which is admitted via inlet 7. At the same time, the pressure of fuel which is admitted via inlet 7 cannot reach that value at which the pintle 12 is lifted to permit expulsion of fuel from the chamber 17 by way of the outlet opening in the tip of the nozzle 3. When the pump plunger 11 again performs a working stroke, the pressure in the chambers 17, 18 and in the path between these chambers rises to a value at which the fuel in the chamber 17 acts upon the shoulder **12*b* of the pintle 12 and lifts the latter against the opposition of the spring 12*a* to expel fuel from the nozzle 3**.

A check valve 13 is installed in the nozzle holder 6 to prevent fuel from flowing into the inlet 7 while the plunger 11 performs a working stroke. Each stroke of the plunger 11 entails an advancement of the batch of fuel which is admitted via inlet 7 so that such batch advances stepwise toward and into the chamber 17 at a rate which is a function of the strokes of the plunger 11 and of the capacity of the means that defines the path (in 5 and 6*a*) between the locus of admission of fuel via inlet 7 and the outlet opening which is normally sealed by the tip of the pintle 12.

The inlet 7 is provided in the holder 6 in addition to the customary leak-off connection 8 which allows for escape of leak fuel, if any, from the spring compartment 5. This compartment accommodates a disc 9 which determines the initial stressing of the spring 12*a*, i.e., the thickness of the disc 9 determines the axial length of the spring 12*a* when the pintle 12 seals the outlet opening of the chamber 17.

FIG. 1 further shows a source 201 of fuel and a regulating unit 301 for the pump element 101.

As a rule, the intervals during which the pressure in the conduit including the pipe 4 and bore 6*a* is low are much longer than the intervals during which the plunger 11 maintains fuel in such conduit at an elevated pressure, namely at a pressure which suffices to cause expulsion of fuel from the chamber 17.

The regulating unit 301 can control the operation of the additional pump element 101 in such a way that the latter conveys fuel from the source 201 into the bore 6*a*, which is provided in the nozzle 3 and connects the pipe 4 with the chamber 17, when the pump element 1 allows for a reduction of pressure in the conduit 4 and chamber 19. The quantity of fuel which is admitted by the pump element 101 depends on the dimensions of the delivery or relief valve 2 and conduit 4, 6*a*, on the elasticity of fuel, and the pressure which can be generated by the pump element 101. One or more of these parameters can be readily selected in such a way that the percentage of additional fuel in the mixture of primary and additional fuel remains within the desired range. Moreover, it is possible to pump only additional fuel via inlet 7 or to pump only primary fuel via conduit 4. The length of the pipe 4 can be varied within a desired range to thereby change or properly select the volume of the means for storage of primary or additional fuel between the chamber 18 and the bore 6*a*.

For example, fuel which is pumped from the source 201 can be used to promote starting of the engine in cold weather or under other adverse circumstances. The additional fuel is then a fuel which exhibits a more satisfactory combustibility than the fuel which is supplied via inlet 10. The regulating unit 301 is set to ensure that the quantity of additional fuel which is admitted via inlet 7 for the purposes of ignition is properly related to the initial RPM of the engine. Once a required quantity of additional fuel is confined in the path between the chamber 18 and the tip of the pintle 12, the pump element 101 is arrested and the pump element 1 is started to ensure the injection of additional fuel into the combustion chamber of the engine at an optimum rate, i.e., a preselected quantity in response to each compression stroke of the plunger 11. Alternatively, the pump element 101 can continue to operate intermittently while the pump element 1 is caused to reciprocate its plunger 11 so that the inlet 7 admits additional fuel at the rate at which the plunger 11 expels additional fuel from the chamber 17. At such time, the inlet 10 is or can be sealed so that primary fuel which is located in the chamber 18 merely acts as a piston which pumps additional fuel during the intervals of idleness of the pump element 101, i.e., while the element 101 is not in the process of pumping additional fuel from the source 201 into the bore 6*a*.

The additional inlet 7 can be provided at a distance from the nozzle holder 6, e.g., in the body of the delivery valve 2 downstream of the chamber 18. If such additional fuel is used for facilitating the starting of the engine, it is necessary to delay the starting of the engine until the path between the inlet 7 in the valve 2 and the outlet of the chamber 17 is filled with additional fuel so that the nozzle 6 will discharge additional fuel in response to starting of the pump element 1. In other words, the pump element 1 is idle while the pump element 101 admits fuel into the path between the additional inlet 7 and the outlet of the chamber 17 and the pump element 1 then again operates in the customary way to inject additional fuel into the combustion chamber of the engine.

The rate at which primary fuel which is admitted by the pump element 1 is mixed with fuel which is admitted by the auxiliary or additional pump element 101 (such mixing takes place or can take place in the path which includes the chambers 17, 18 and the conduit means 4, 6*a*) can be selected in accordance with the equation that the percentage of additional fuel in the fuel which is injected into the combustion chamber of the engine is 100 times the quantity of additional fuel divided by the quantity of injected fuel. Such ratio can be regulated by the unit 301 by selecting the quantity of additional fuel which is injected by the auxiliary pump element 101. If desired, the ratio of the two fuels can be selected in such a way that, once the pump element 101 begins to admit fuel via inlet 7, the percentage of additional fuel is increased to 100 percent and the percentage of primary fuel is reduced to zero.

It is preferred to keep the volume of the space between the check valve 13 and the chamber 17 to a minimum, i.e., to use a small-diameter bore 6*a* and/or to place the inlet 7 close to the chamber 17.

The pump element 101 can be started while the engine is idle or while the engine is running. Moreover, the pump system can employ two or more additional or auxiliary pump elements and an equal number of additional inlets. One of the presently preferred uses of the improved pump system is to facilitate starting of the engine in cold weather by injecting an additional or secondary fuel whose combustibility is more satisfactory than that of the primary fuel. However, it is equally possible to inject additional fuel while the engine is running and is hot.

It is further possible to start the additional pump element 101 shortly before the engine is brought to a halt so that the path between the inlet 7 and the outlet of the chamber 17 is filled or practically filled with additional fuel before the engine is arrested. This means that the combustion chamber receives additional fuel as soon as the engine is restarted. The fuel which is admitted via inlet 10 or the fuel which is admitted via inlet 7 can contain or can consist of a vegetable oil.

Figure 2:
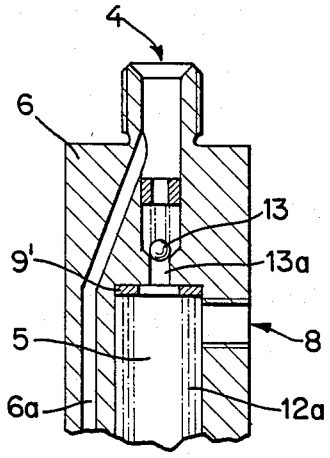
FIG. 2 is a fragmentary axial sectional view of a modified nozzle.

FIG. 2 shows a portion of a modified pump system wherein the leak-off connection 8 constitutes the second inlet (i.e., it replaces the inlet 7 of FIG. 1) and the check valve 13 is installed in a bore 13*a* which connects the spring compartment 5 with that portion of the path defined by the pipe 4 for the flow of fuel from the main pump element 1 which leads into the holder 6. The means for regulating the bias of the spring 12*a* in the compartment 5 includes a washer-like member 9' against which the topmost convolution of the spring 12*a* reacts and whose thickness determines the initial spring bias. Such washer-like member can be made of a metallic or a plastic material. The additional or auxiliary pump element (not shown in FIG. 2) which admits fuel into the connection 8 further serves as a means for returning leak fuel from the spring compartment 5 into the path for the flow of fuel from the plunger 11 to the chamber 17 of the nozzle 3. Thus, the nozzle of FIG. 2 can circulate fuel which is admitted by the pipe 4; such circulation takes place from the upper end of the holder 6 via bore 6*a* to the chamber 17 (not shown in FIG. 2), from the chamber 17 to the compartment 5, and from the compartment 5 through the central opening of the member 9', bore 13*a*, valve 13 and back into the bore 6*a* leading from the conduit 4 into the chamber 17. Such circulation is effected by the pump (corresponding to the pump element 101 of FIG. 1) which is used to admit additional fuel via connection 8.

Figure 3:
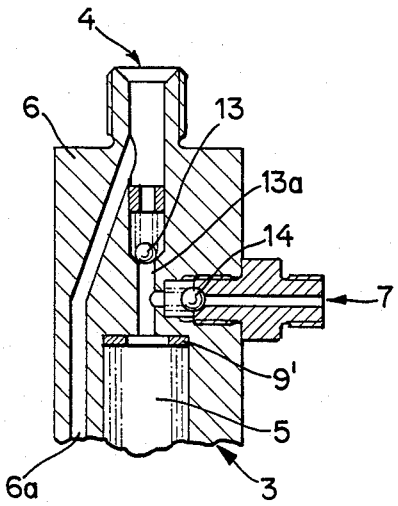
FIG. 3 is a fragmentary axial sectional view of a third nozzle.

FIG. 3 shows a pump system which constitutes a modification of the pump system of FIG. 2. The additional inlet 7 discharges fuel into a bore 13*a* which is machined into or is otherwise formed in the holder 6 and is controlled by a check valve 13. A further check valve 14 prevents return flow of fuel from the bore 13*a* into the inlet 7. Fuel which is admitted via inlet 7 first enters the spring compartment 5 and enters the path (bore 6*a*) between the chambers 18 and 17 after overcoming the resistance of the check valve 13. This check valve prevents the flow of fuel from the pipe 4 directly into the compartment 5, and the check valve 14 prevents return flow of fuel from the compartment 5 into the inlet 7. The pump system of FIG. 3 need not be provided with a leak-off connection 8. This pump system can also circulate fuel in the nozzle 3, namely from the inlet 7 via check valve 14, bore 13*a*, check valve 13, bore 6*a*, chamber 17 (not shown) spring compartment 5, bore 13*a* and check valve 13. Alternatively, fuel can circulate from the pipe 4, via bore 6*a*, chamber 17, compartment 5, bore 13*a* and valve 13 back into the bore 6*a*.

An advantage of the improved pump system is that, in contrast to prior proposals, additional fuel is admitted into the path of fuel between the chamber 18 of the valve 2 and the chamber 17 of the injector nozzle 3. Thus, it is not necessary to mix two or more different fuels in the chamber 18, an it is not necessary to provide a discrete path for the flow of additional fuel from the inlet 7 to the opening that is controlled by the tip of the pintle 12. Still further, it is not necessary to unduly enlarge the pintle 12 by providing therein two or more paths for the flow of different types of fuel toward the combustion chamber. Admission of additional fuel into the existing path for the flow of primary fuel from the chamber 18 into the chamber 17 of the nozzle 3 contributes to simplicity, compactness, reliability and lower cost of the improved pump system. In addition, the improved pump system can introduce one or more additional fuels as close to the tip of the pintle 12 as desired, and this can be achieved without the need for one or more additional conduits with attendant elimination of problems involving the establishment of leak-free connections between the ends of a conduit and the parts which are attached thereto. Moreover, it is not necessary to greatly enlarge the holder 6 and/or any other parts of the injector nozzle 3 since the existing path for the flow of fuel from the chamber 18 into the chamber 17 can serve to convey additional fuel or fuels to the chamber 17. In other words, the existing path for the flow of fuel from the pump 1 to the chamber 17 can be used as a path for admission and conveying of one or more additional fuels. A further important advantage of the improved pump system is that it can be obtained as a result of a rather simple and inexpensive conversion of an existing pump system; all that is necessary is to replace a conventional nozzle with the nozzle which is constructed in a manner as shown in FIGS. 1 to 3 (or an analogous nozzle) and to provide one or more additional or auxiliary pumps, depending on the number of additional inlets in the nozzle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A pump system for injection of fuel into an engine, such as a diesel engine, comprising a main pump element having an inlet for admission of fuel and an outlet for fuel which is admitted via said inlet, said main pump element being arranged to perform strokes for advancement of fuel from said inlet to said outlet; a delivery valve connected with said outlet and having a first chamber for fuel which is conveyed by said pump element; an injector nozzle having a second chamber with an opening for fuel which is to be injected into the engine and a compartment for leak fuel which escapes from said second chamber into said nozzle instead of through said opening during injection of fuel from said chamber into the engine; conduit means connecting said chambers; and at least one additional inlet for admission of fuel into said conduit means, said nozzle having means for conveying leak fuel from said compartment into said conduit means for readmission into said second chamber so that leak fuel does not leave said nozzle.

2. The pump system of claim 1, wherein said delivery valve has means for intermittently relieving pressure in said conduit means, and further comprising an auxiliary pump element operative to supply into said conduit means fuel by way of said additional inlet while the pressure in said conduit means is relieved by said delivery valve, and check valve means operating between said additional inlet and said conduit means to prevent the flow of fuel from said conduit means into said additional inlet.

3. The pump system of claim 2, wherein said auxiliary pump element is a manually operable element.

4. The pump system of claim 2, wherein said auxiliary pump element includes a power-driven pump element.

5. The pump system of claim 2, wherein said auxiliary pump element has means for injecting fuel by way of said additional inlet at a pressure exceeding the pressure in said conduit means when the pressure in said conduit means is relieved by said distributor valve.

6. The pump system of claim 2, wherein said nozzle comprises means for permitting expulsion of fuel from said second chamber at a predetermined pressure, said auxiliary pump element having means for injecting fuel by way of said additional inlet at a pressure which is less than said predetermined pressure.

7. The pump system of claim 2, wherein said conduit means has a predetermined capacity and said main pump element has means for raising the pressure of fuel to a predetermined value, said auxiliary pump element having means for admitting fuel by way of said additional inlet in quantities which depend on the capacity of said conduit means and at a pressure which is a function of the dimensions of said delivery valve, of the elasticity of fuel and on the pressure of fuel which is supplied by said additional pump element.

8. The pump system of claim 1, wherein said main pump element includes means for admitting into said first chamber first predetermined quantities of fuel per stroke and said auxiliary pump element includes means for admitting second predetermined quantities of fuel per stroke not exceeding said first quantities.

9. The pump system of claim 1, wherein said nozzle includes a holder and said additional inlet is provided in said holder.

10. The pump system of claim 1, wherein said nozzle includes a reciprocable pintle and a spring for said pintle, said spring being disposed in said compartment and said conveying means defining a path for the flow of leak fuel therein from said compartment to said second chamber, said nozzle being devoid of a leak-off connection to said compartment and said additional inlet communicating with said compartment.

11. The pump system of claim 10, wherein said nozzle includes a first portion including a holder and a fuel-discharging second portion, said additional inlet being provided in the first portion of said nozzle.

12. The pump system of claim 10, further comprising means for regulating the bias of said spring, said regulating means including a washer-like member in said compartment.

13. The pump of claim 1, wherein said nozzle includes a reciprocable pintle and a spring for said pintle, said nozzle defining a compartment for said spring and said conduit means communicating with said compartment, said additional inlet communicating with said conduit means by way of said compartment and said nozzle being devoid of a leak-off connection to said compartment.

14. The pump system of claim 13, further comprising a check valve operating between said compartment and said additional inlet to prevent the flow of fuel from said compartment into said additional inlet.

15. The pump system of claim 14, wherein said delivery valve has means for intermittently reducing pressure in said conduit means, and further comprising an auxiliary pump element for admitting into said compartment fuel by way of said additional inlet at a pressure exceeding the pressure of fuel in said conduit means when the pressure in said conduit means is reduced by said delivery valve.

16. The pump system of claim 13, wherein said nozzle includes a first portion including a holder and a fuel-discharging second portion, said additional inlet being provided in the first portion of said nozzle.

17. The pump system of claim 13, further comprising means for regulating the bias of said spring, said regulating means including a washer-like member in said compartment.

18. The pump system of claim 1, further comprising an auxiliary pump element having means for admitting into said additional inlet batches of fuel so that such batches are advanced by way of said conduit means and to the opening of said nozzle in stepwise fashion as a function of the capacity of said conduit means and the frequency of strokes which are performed by said main pump element.

19. The pump system of claim 1, wherein the fuel which is admitted through the inlet of said main pump element is a vegetable oil.

20. The pump system of claim 1, further comprising a check valve provided in said nozzle to prevent fuel from flowing from said conveying means into said additional inlet, said conduit means and said conveying means providing a small volume for fuel between said check valve and said second chamber.

* * * * *